US006004174A

United States Patent [19]

Govan

[11] Patent Number: 6,004,174

[45] Date of Patent: Dec. 21, 1999

[54] ROTARY WEED AND LINE CUTTER

[76] Inventor: Donald T. Govan, Box 350246, Fort Lauderdale, Fla. 33335

[21] Appl. No.: 09/286,676

[22] Filed: Apr. 6, 1999

Related U.S. Application Data

[60] Provisional application No. 60/119,913, Feb. 11, 1999.

[51] Int. Cl.[6] ..... B63H 1/28

[52] U.S. Cl. ..... 440/73; 416/146 R

[58] Field of Search ..... 440/73, 71, 49, 440/46; 416/146 R, 146 B

[56] References Cited

U.S. PATENT DOCUMENTS

| | | | |
|---|---|---|---|
| 4,447,215 | 5/1984 | Govan | 440/71 |
| 4,507,091 | 3/1985 | Govan | 440/73 |
| 4,544,363 | 10/1985 | Govan | 440/73 |
| 4,801,281 | 1/1989 | Govan | 440/73 |
| 4,943,249 | 7/1990 | Govan | 440/73 |
| 5,017,167 | 5/1991 | Govan | 440/73 |
| 5,052,957 | 10/1991 | Govan | 440/73 |
| 5,547,408 | 8/1996 | Skyman | 440/73 |
| 5,807,150 | 9/1998 | Minter | 440/73 |

*Primary Examiner*—Sherman Basinger
*Assistant Examiner*—Patrick Muldoon
*Attorney, Agent, or Firm*—Alvin S. Blum

[57] ABSTRACT

Apparatus shears foreign matter such as lines, wires, nets and weeds that can entangle and befoul propellers, propeller shafts, bearings and related structure of propeller-driven, water born vessels. The apparatus shears by cooperative action of a rotating blade that rotates in conjunction with the propeller and a non-rotating blade supported on a non-rotating portion of the vessel. The non-rotating blade moves axially within its support. With each revolution, a slot follower connected to the non-rotating blade engages a slot carried by the rotating blade to adjust the axial position of the non-rotating blade to compensate for axial movement of the rotating blade. A wedge and valley mechanism prevents the two blades being forced apart during shearing action. Roller bearings, radially disposed, reduce friction between slot follower and slot to reduce wear on the parts and thereby prevent malfunction with prolonged operation and to provide low cost replacement of the bearings for maintenance.

10 Claims, 10 Drawing Sheets

ROTARY WEED AND LINE CUTTER

This application is based upon Provisional patent application Ser. No. 60/119,913 filed Feb. 11, 1999.

BACKGROUND OF THE INVENTION

1. Field of the Invention

This invention relates to marine devices that cut lines, nets, weeds and the like, and more particularly to shearing cutters that employ a blade rotating with the propeller of a vessel that cooperates with a non-rotating blade mounted on a non-rotating portion of a vessel adjacent the shaft.

2. Description of the Prior Art

Lines, nets, weeds and the like are commonly encountered by vessels. They may be swept by the propeller blades into the propeller shaft apparatus where they can cause great harm, i.e. into the space where the propeller shaft extends from its housing. There they may cut through the oil seals causing loss of lubricant. The current trend toward long line fishing wherein heavy monofilament nylon many miles long is lying in the water has exacerbated the problem. Applicant's U.S. Pat. No. 4,943,249, Jul. 24, 1990 teaches a unique means for adjusting the distance between a pair of radially extending shearing cutters, one of which is attached to a non-rotating portion of the ship and one of which is attached to a rotating portion of the ship.

The position of the propeller will change relative to the hull, advancing axially when under way in forward due to the forward thrust of the propeller. Heating and cooling of the shaft will also change propeller axial position. A sensing mechanism senses propeller location and a moving mechanism moves the non-rotating blade to accommodate these changes in relative propeller location to maintain a fixed, very close spacing between the two blades for effective shearing action.

U.S. Pat. Nos. 4,447,215; 4,507,091; 4,544,363 and 4,801,281 issued to Applicant disclose means for mounting both rotating and non-rotating shearing blades on the shaft so that axial shaft displacement has no effect on relative blade spacing. A simple, inexpensive mechanism for maintaining the correct distance between a rotating blade on a shaft or propeller and a non-rotating blade mounted on a non-rotating portion of the ship for optimum shearing action between the two blades despite axial movement of the shaft and propeller would be useful for many waterbome craft.

Applicant's U.S. Pat. No. 5,017,167 issued May 21, 1991 teaches a slot and slot follower mechanism for maintaining relative axial position between rotating and non-rotating parts of a line and weed cutter mechanism to compensate for axial movement of the propeller and shaft, with the slot rotating and the slot follower not rotating. Cutting lines and weeds free of the rotating shaft and propeller enhances propeller efficiency and prevents line from damaging the shaft seals. However, prolonged operation causes excessive wear between the slot and slot follower from constantly rubbing against each other. This alters the relative axial alignment between the parts leading to functional failure and requiring expensive replacement of large parts.

SUMMARY OF THE INVENTION

It is accordingly an object of the invention to provide a shearing cutter system in which a non-rotating blade mounted on a non-rotating portion of a vessel cooperates with one or more rotating blades that includes a simple and inexpensive means for maintaining an optimal spacing between blades for effective shearing action to overcome axial movement of the rotating elements. The system includes a non-rotating blade that has a shearing plane perpendicular to the axis of rotation of the shaft. This blade rides in a blade holder that permits limited axial movement of the blade. The blade holder generally mounts on a strut or the rope guard that surrounds the rotary shaft and its bearing. One or more rotating blades are mounted on the propeller with a shearing plane parallel to the non-rotating blade. The shearing planes of the two blades must be very close together for effective cutting. To ensure optimal axial positioning of the two blades, the rotating blade carries along with it a positioning groove or slot. The non-rotating blade carries a slot follower with tapered leading and following edges. As the slot encounters a tapered edge of the slot follower during its rotation, the slot follower and its blade are moved axially until the slot follower fits into the slot, thereby moving the two blades into the blade spacing necessary for optimal shearing action. It is a further object of the invention to provide means for reducing friction and wear between the slot and slot follower of the mechanism. It is a further object to provide radially disposed roller bearing operatively positioned to reduce friction and wear between the slot and slot follower. It is a further object that these bearings be easily replaceable for reduced downtime and maintenance costs. Adjustable damping means are provided to slow the axial movement to avoid excessive axial movement between revolutions from the thrust of the moving water that includes means for maintaining a preset tension of the damping adjustment over time. Means are also provided for resisting forces that tend to spread the blades apart when a foreign object is being sheared by the blades.

The line cutters of the prior art that carry the non-rotating blade on a blade carrier attached to the shaft require a special blade and blade carrier for each shaft diameter. Furthermore, since the carrier is continuously rotating and the blade is not, a bearing between the two is subject to considerable wear and damage, requiring periodic replacement. The instant invention can be installed on a variety of shaft diameters, and it overcomes the bearing problem because the slot follower is only briefly in the slot during each revolution, and roller bearings carried by the slot follower reduce friction therebetween.

These and other objects, features and advantages of the invention will become more apparent when the detailed description is studied in conjunction with the drawings, in which like reference characters indicate like elements in the various drawing figures.

DETAILED DESCRIPTION OF PREFERRED EMBODIMENTS

Figure 1:
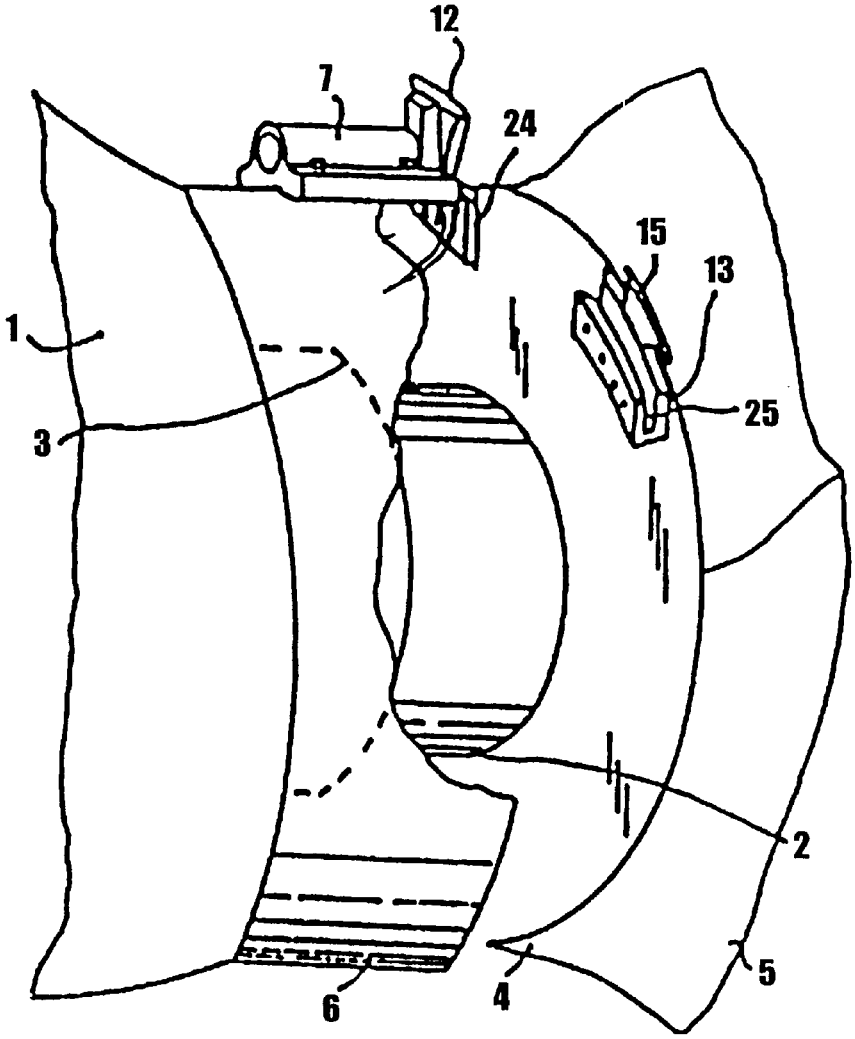
FIG. 1 is a perspective view, partially broken away, of the apparatus of the invention installed on a vessel.
Figure 2:
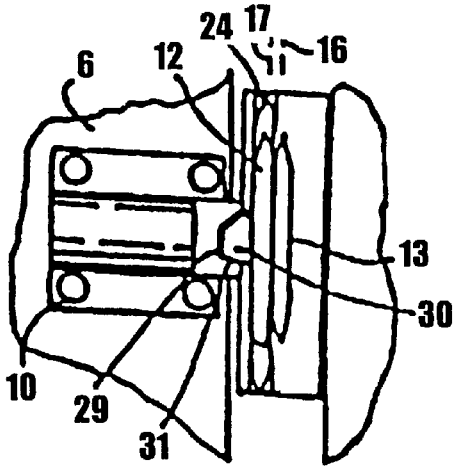
FIG. 2 is a top view of the apparatus of FIG. 1.
Figure 3:
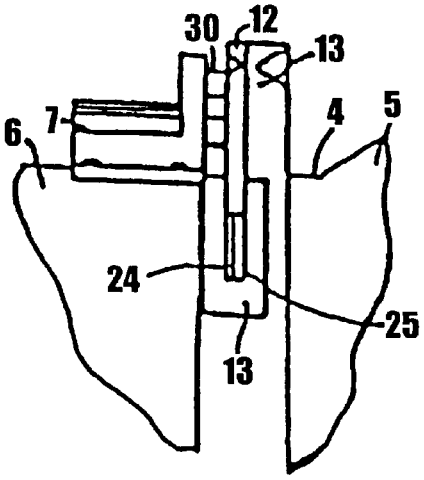
FIG. 3 is a side elevation view of the apparatus of FIG. 1.
Figure 6:
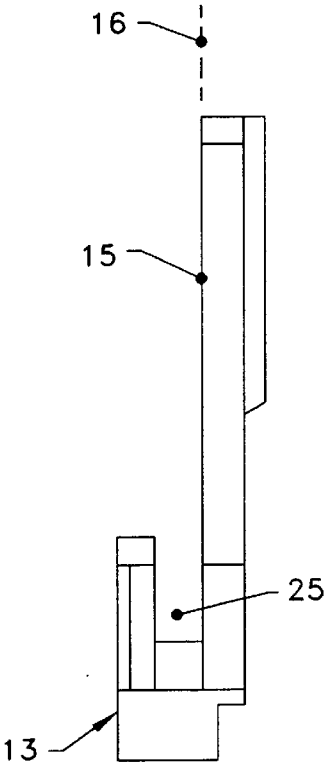
FIG. 6 is a side elevation view of the rotating blade.
Figure 5:
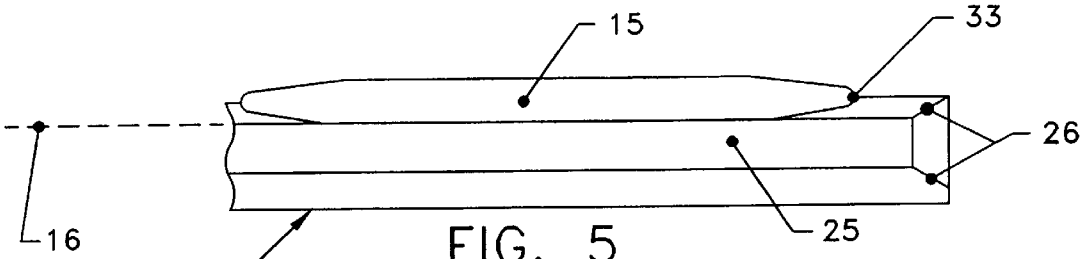
FIG. 5 is a top view, partially broken away, of the rotating blade.
Figure 4:
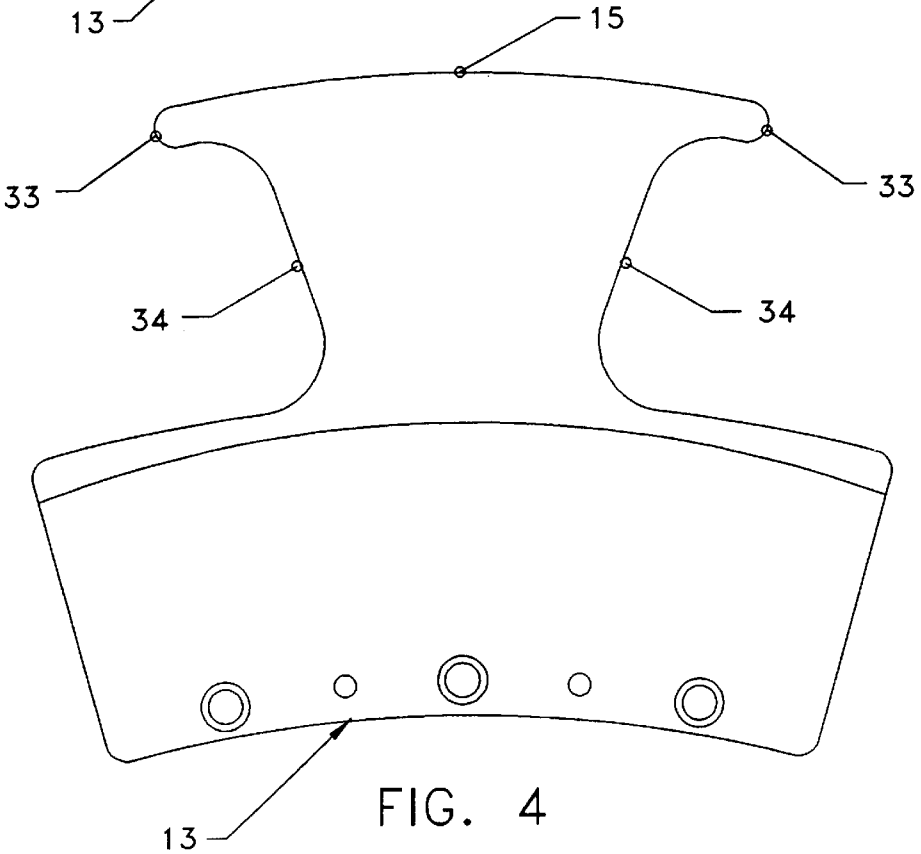
FIG. 4 is a front elevation view of the rotating blade.
Figure 9:
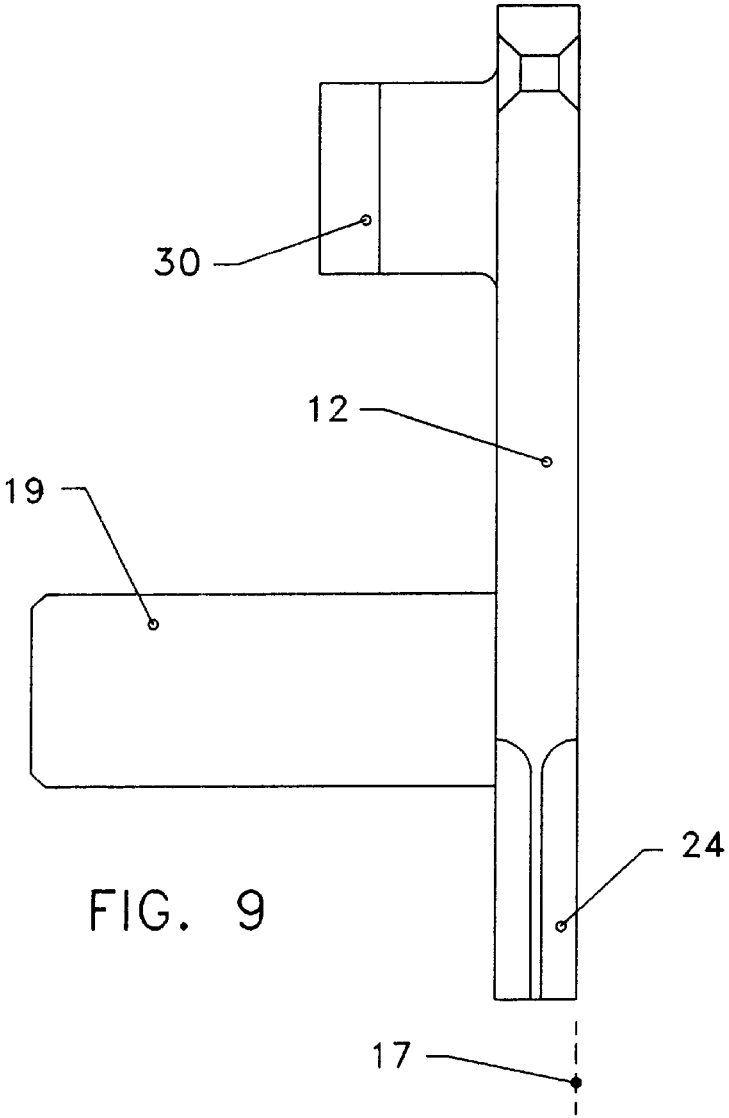
FIG. 9 is a side elevation view of the non-rotating blade.
Figure 12:
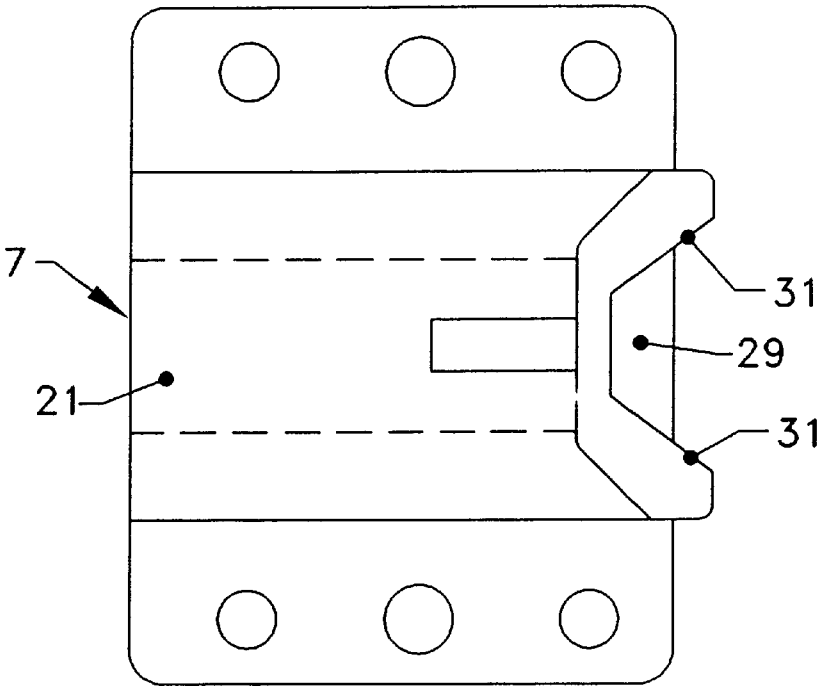
FIG. 12 is a top view of the support block.
Figure 13:
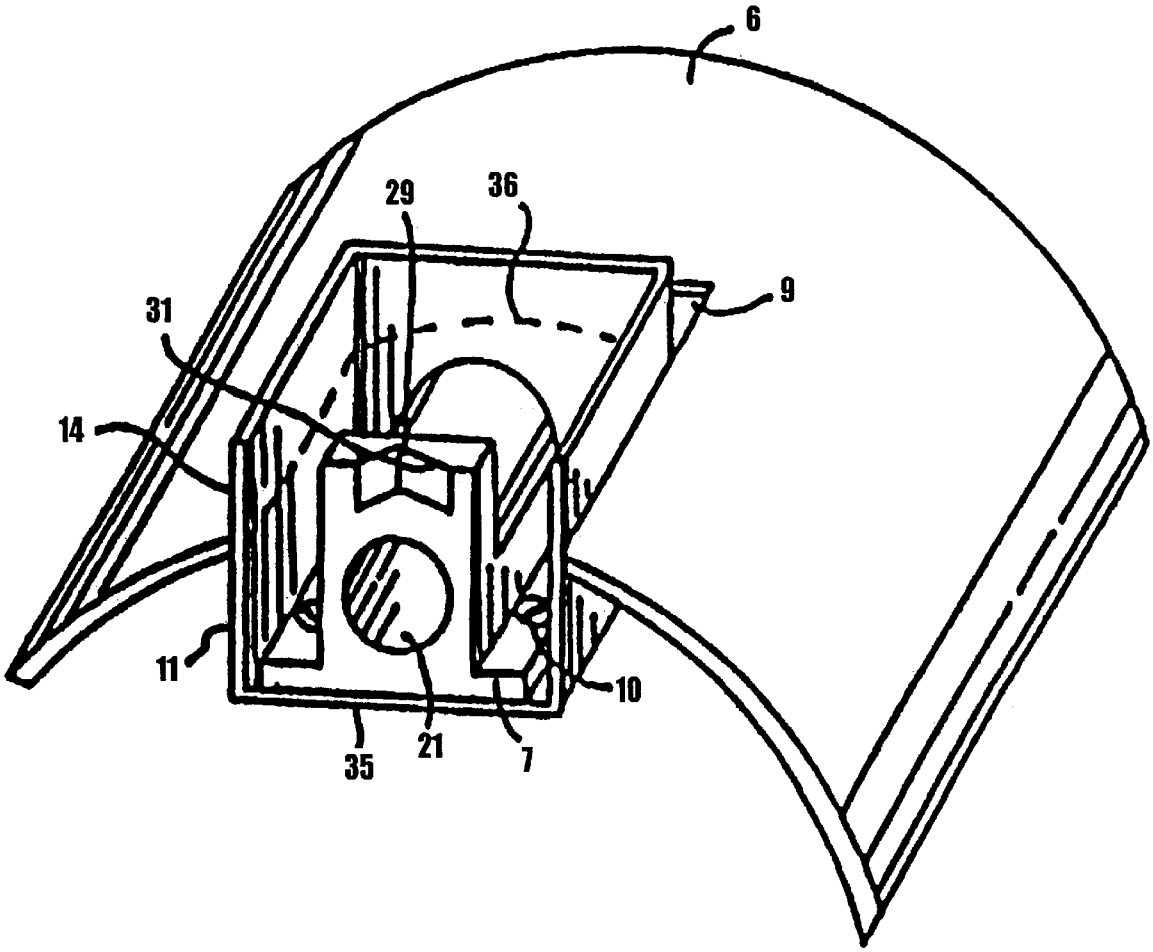
FIG. 13 is a perspective view of a box member in position in an aperture cut in a rope guard for holding the support block in correct position.

Referring now first to FIGS. 1–3, a vessel 1 has a propeller shaft 2 journalled within a propeller shaft housing 3 with a propeller hub 4 carrying propeller 5 affixed to the shaft. A rope guard 6 surrounds the shaft and is fixed to the vessel. A support block 7 for supporting the non-rotating blade 12 is bolted to the rope guard 6 in correct position for cooperating blade assembly 13. Alternatively, as shown in FIG. 13, an aperture 9 is cut in rope guard 6. The support block 7 is bolted by bolts to the floor 35 of a box member 11. The box member is adjusted to correct position relative to the rotating blade assembly 13 and welded to the rope guard 6 by the parallel sides 14, and projecting portions cut off at line 36. This provides wider latitude in adjustment to suit a greater variety of installations with fewer sizes of apparatus. The rotary blade assembly 13 is bolted to the propeller hub 4 so that the rotary blade 15 extends radially beyond the hub 4, with its shear plane 16 perpendicular to the axis of shaft 2. This positions the blade 15 so that it catches foreign matter as it turns and twists it inward where it will be caught and sheared against the non-rotating blade 12. Blade 12 is held radially extended with its shearing plane 17 parallel to the shearing plane 16 of the rotary of the rotary blade 15 by the support block 7. For most effective shearing by the two blades' shearing edges 34, the two shearing planes are best spaced apart a distance of approximately 0.005 inches according to current observations. During operation of the vessel, various forces are at work that tend to move the propeller axially relative to the supporting structures holding the non-rotating blade 12. These forces include thrust of the propeller blades against the water and expansion and contraction from heating and cooling. In order to maintain optimum spacing of the two blades when the rotating blade is moved axially by these forces, the non-rotating blade supported by the fixed support block must move axially by a corresponding amount. The axial movement of blade 12 within support block 7 is provided by cylinder 19 extending from blade 12, as best seen in FIG. 9, which slides axially within lubricous sleeve bearing 20 fixed in axial hole 21 in support block 7, as best seen in FIG. 11.

Figure 8:
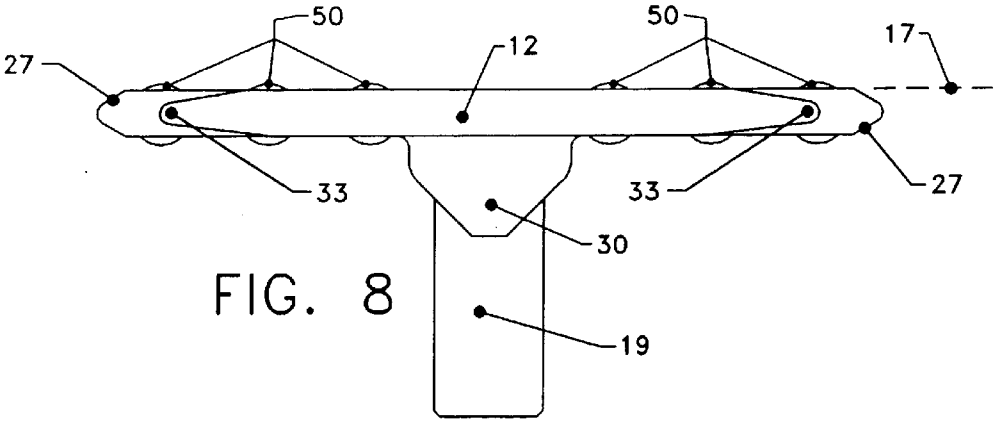
FIG. 8 is a top view of the non-rotating blade.
Figure 7:
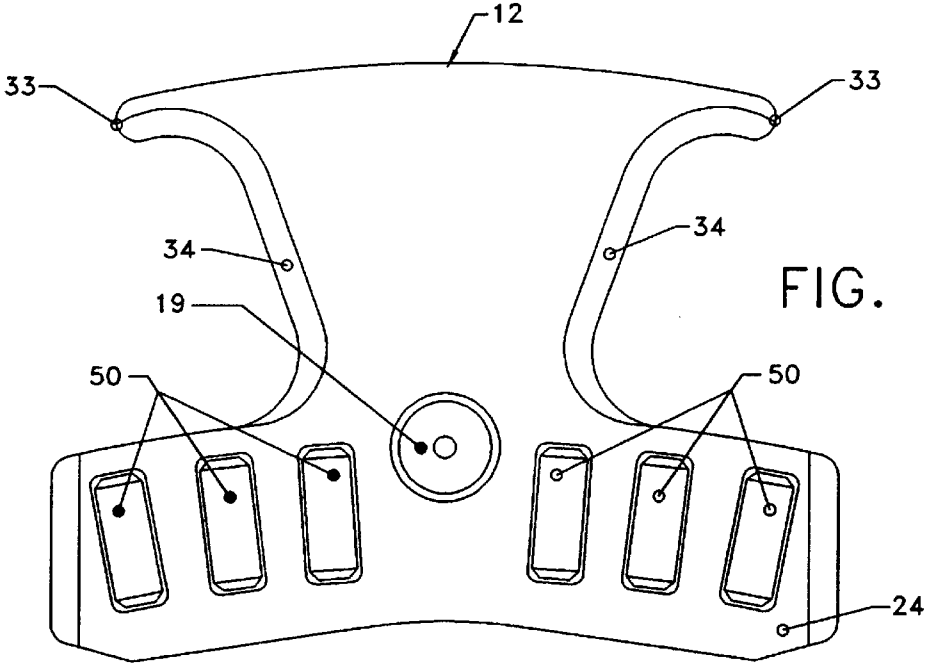
FIG. 7 is a front elevation view of the non-rotating blade.
Figure 10:
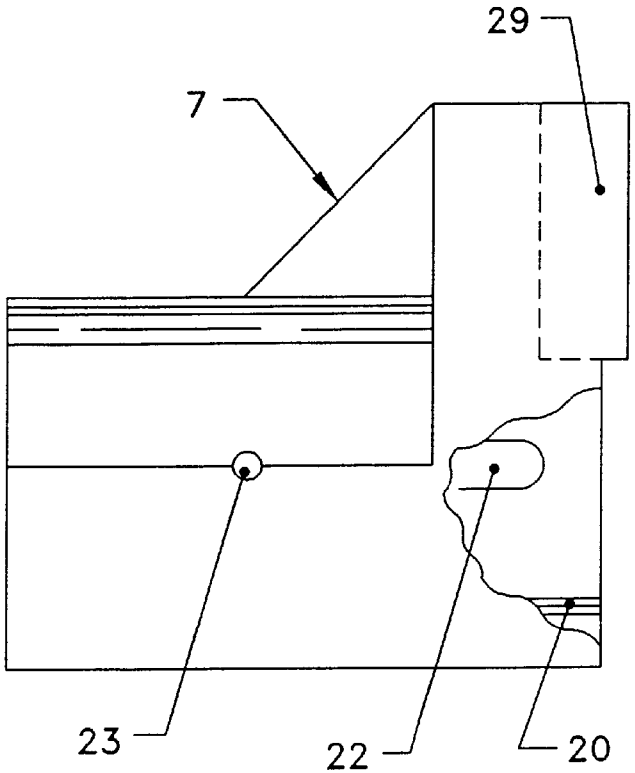
FIG. 10 is a side elevation view of the support block, partially broken away.
Figure 11:
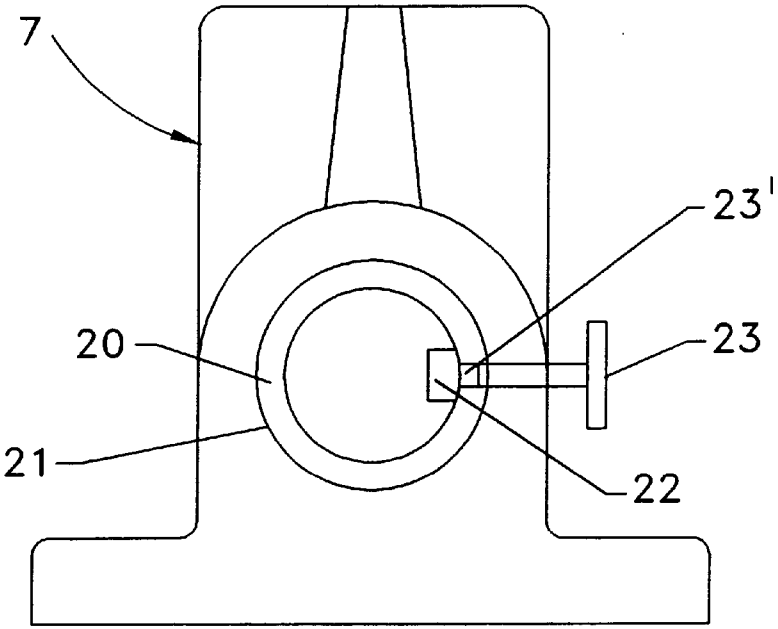
FIG. 11 is a rear elevation view of the support block.

As best seen in FIGS. 10 and 11, an elongate segment 22 of the sleeve bearing 20 is free to move radially within an aperture in the bearing 20. Stainless steel screws 23 threadably engaged in block 7 are forced against segment 22 to press in against cylinder 19 of blade 12 to apply an adjustable clamping force on the cylinder. This controllably restricts both axial and pivotal motion of cylinder 19 in the support block 7. The screws 23 have at their tip ends a molded -on polyurethane elastomeric segment 23' that has 100% elastic memory. When initially compressed by turning screw 23, it transmits a spring bias to segment 22 to provide a preset resistance to movement of blade 12. The elastic properties of segment 23' maintain that damping adjustment over prolonged time periods. The primary control mechanism for maintaining optimum spacing between the two blades is provided by the slot follower 24 connected to blade 12 that fits within slot 25 connected to rotary blade assembly 13. As best seen in FIGS. 1-3, with every propeller revolution, the beveled leading edge 26 of the slot 25 encounters the tapered leading edge 27 of the slot follower 24, and the non-rotating blade 12 is moved axially under the inclined plane forces until the slot follower fits into the slot. The damping effects of the clamping plate 22 prevents the blade 12 from moving between revolutions so that there are relatively small forces between slot and slot follower during most revolutions. When the propeller does move axially, then the slot follower moves blade 12 correspondingly. As best seen in FIGS. 7 and 8, roller bearings 50 mounted radially on slot follower 24 tangentially engage the slot 25 because they extend slightly beyond the faces of the slot follower. They thereby prevent sliding contact therebetween, reducing friction and wear.

When cutting a heavy cord with a scissors, there is a tendency for the blades to be forced apart. If this happens, the shearing action of the blades is lost. The blades of the instant invention are prevented from being forced apart by the slot follower engaging the slot before the shearing edges 34 of the blades come into shearing alignment. A wedge and valley mechanism is also provided to maintain blade spacing during shearing. As best seen in FIGS. 2, 8, 9, 12, 13, the support block 7 has a valley 29 with sloping sides 31. The non-rotating blade 12 is provided with a wedge-shaped projection 30 that fits within the valley 29. When torque is generated by the shearing action, the blade cylinder 19 tends to pivot within the bearing sleeve 20 in the support block. This forces the wedge 30 against one of the sloping sides 31 of the valley. The inclined plane action produces a force vector pushing blade 12 against blade 15. This counteracts the tendency of foreign matter to force the blades apart during shearing.

As best seen in FIGS. 4, 5, 7, 8, at the radial limits of both blades a projection 33 extends beyond each of the shearing edges 34. Each projection 33 is tapered at its leading edge. These tapered projections or ramps are provided as a means of ensuring that the shearing edges will never strike one another as they pass due to inadvertent malpositioning such as blade vibration. If the blade should be malpositioned such that the two shearing edges would touch each other, the tapered ramps 33 would meet each other before that could happen and force the blades apart.

Figure 14:
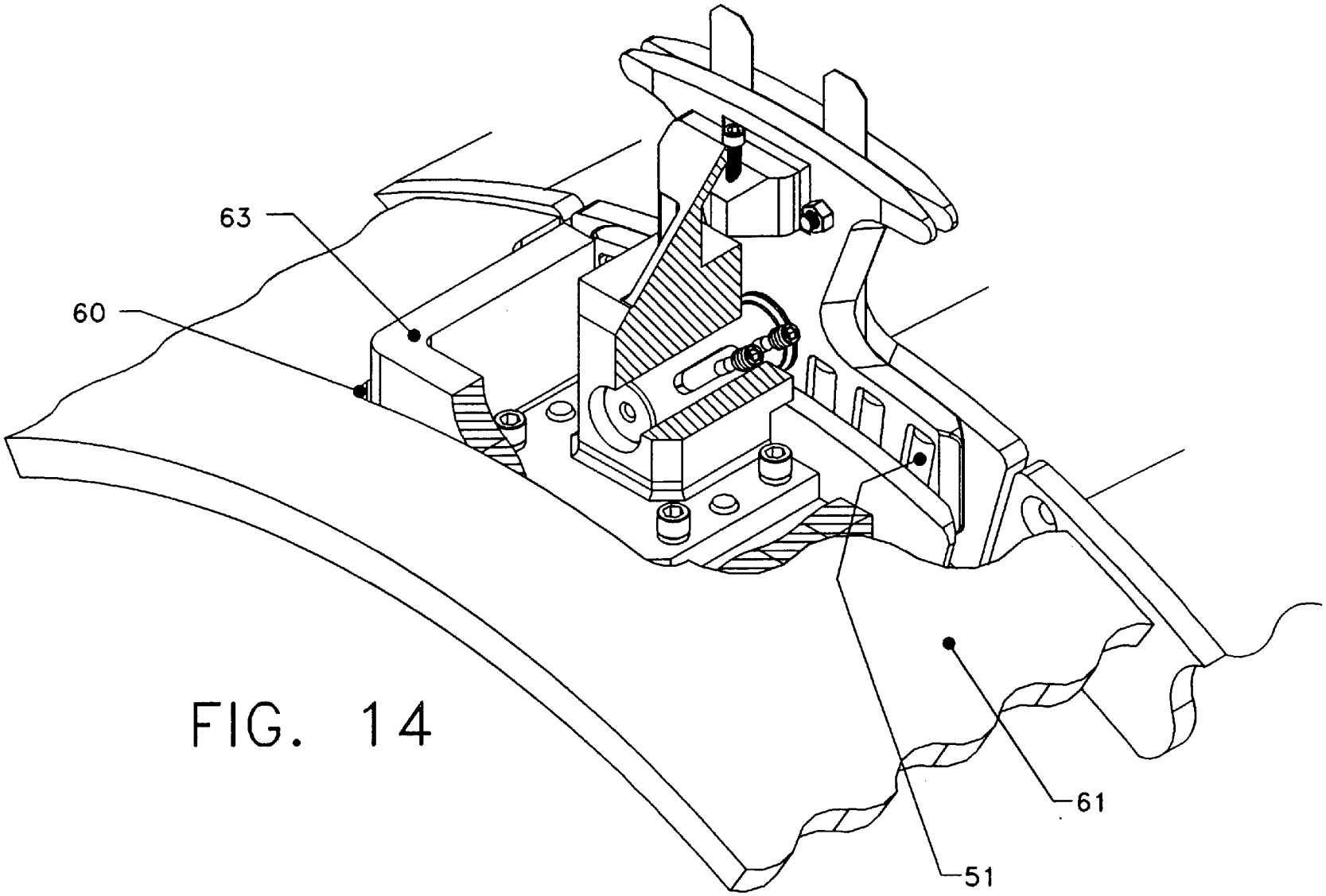
FIG. 14 is a sectional isometric view of another embodiment of the invention.
Figure 15:
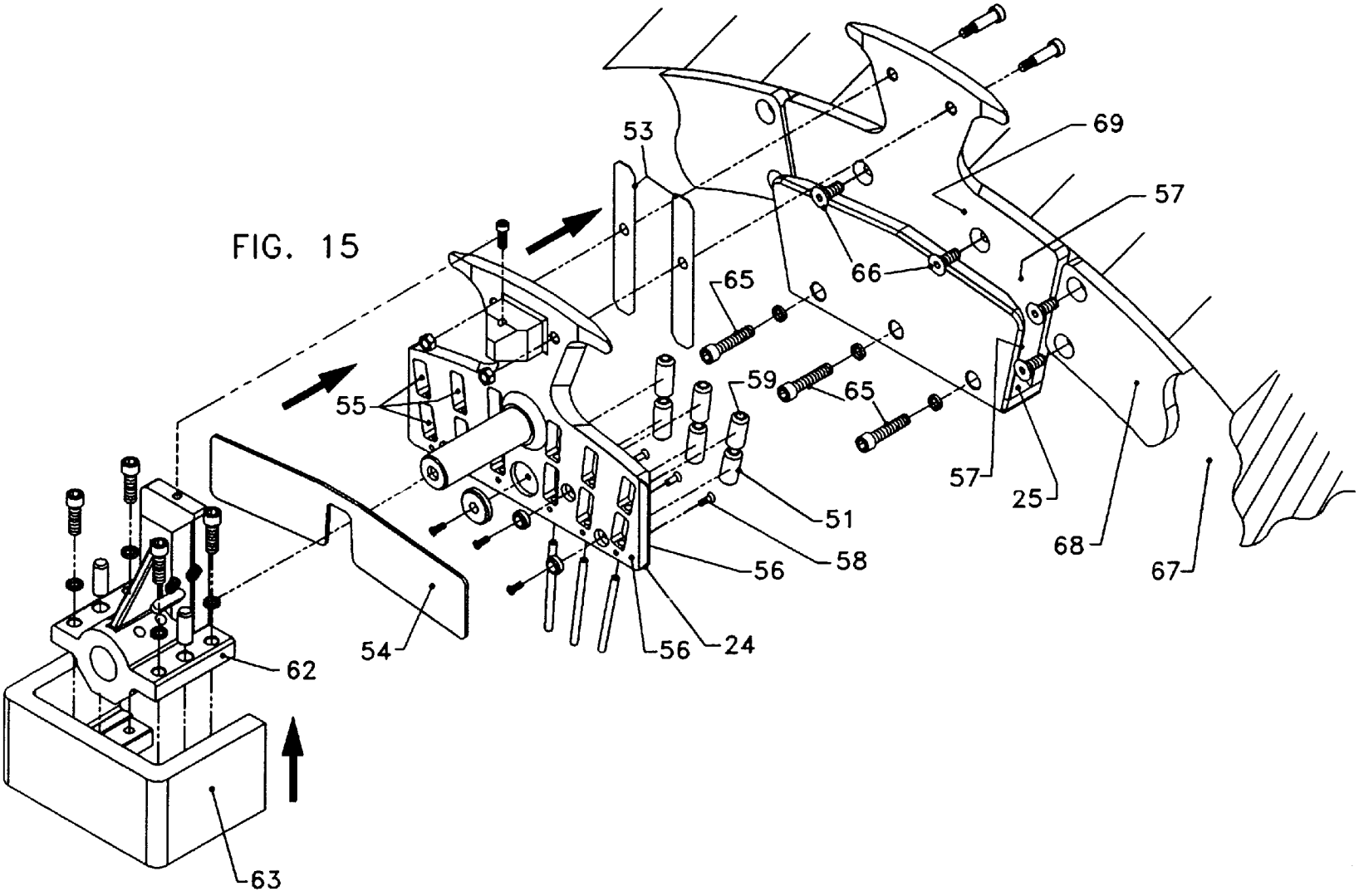
FIG. 15 is an exploded view of the cutter of FIG. 14.
Figure 16:
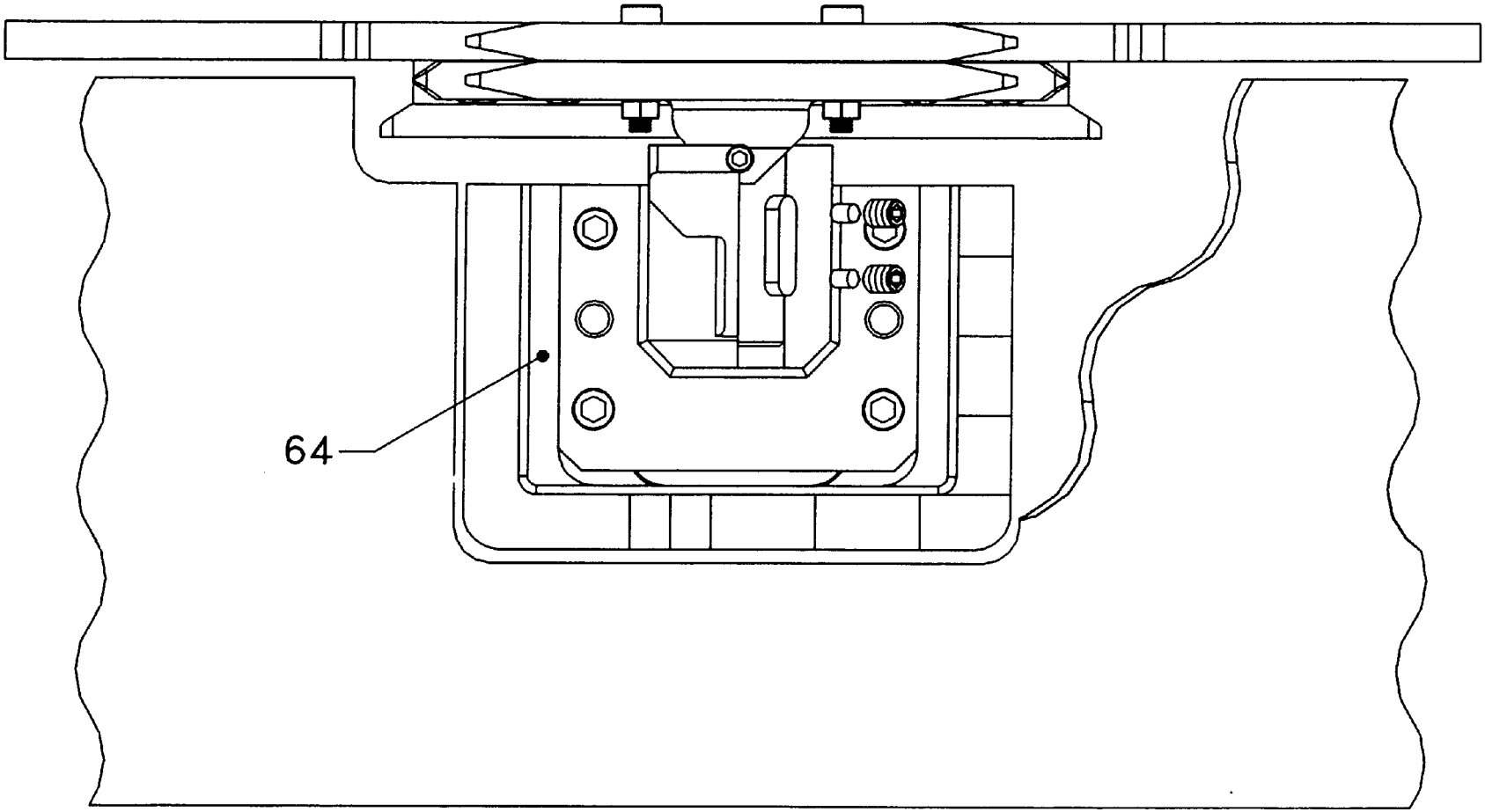
FIG. 16 is a top view of the cutter of FIG. 14.

Referring now to the alternative embodiment shown in FIGS. 14–16, at least one, and preferably many, roller bearings 51 are rotatably mounted radially on the slot follower such that the outer surface of the rotor touches tangentially the inner walls 57 of the slot, preventing direct contact of the metal inner walls 57 of the slot 25' and outer faces 56 of the slot follower 24'. This greatly reduces wear and friction between parts. Each roller extends slightly beyond the outer faces 56 of the slot follower. As it rotates, it picks up a film of water to further reduce friction. The spinning rollers also flush out debris and sand from the slot in a self-cleaning action. The rollers may be fabricated from a material which absorbs water such as, for example, SXL THORDON plastic which reduces wear by hydroplaning on the absorbed water as they spin. The slot follower is provided with through apertures 55. Axles 52 pass radially through the apertures and the axial passage 59 in each roller bearing. Rivet 58 secures the axle in place.

An aperture 60 is cut in the rope guard 61. The assembly is supplied bolted together with spacer shims 53 and welding splatter shield in place, all bolted to the floor 64 of rigid box member 63. The assembly is bolted by bolts 65 and 66 to the leading face of the propeller hub 67. Stainless steel face plates 68 are also bolted to the hub, thereby providing a level surface with the rear inner wall 69 of the slot. The box member is then welded to the rope guard, and the shims and shield removed.

Figure 17:
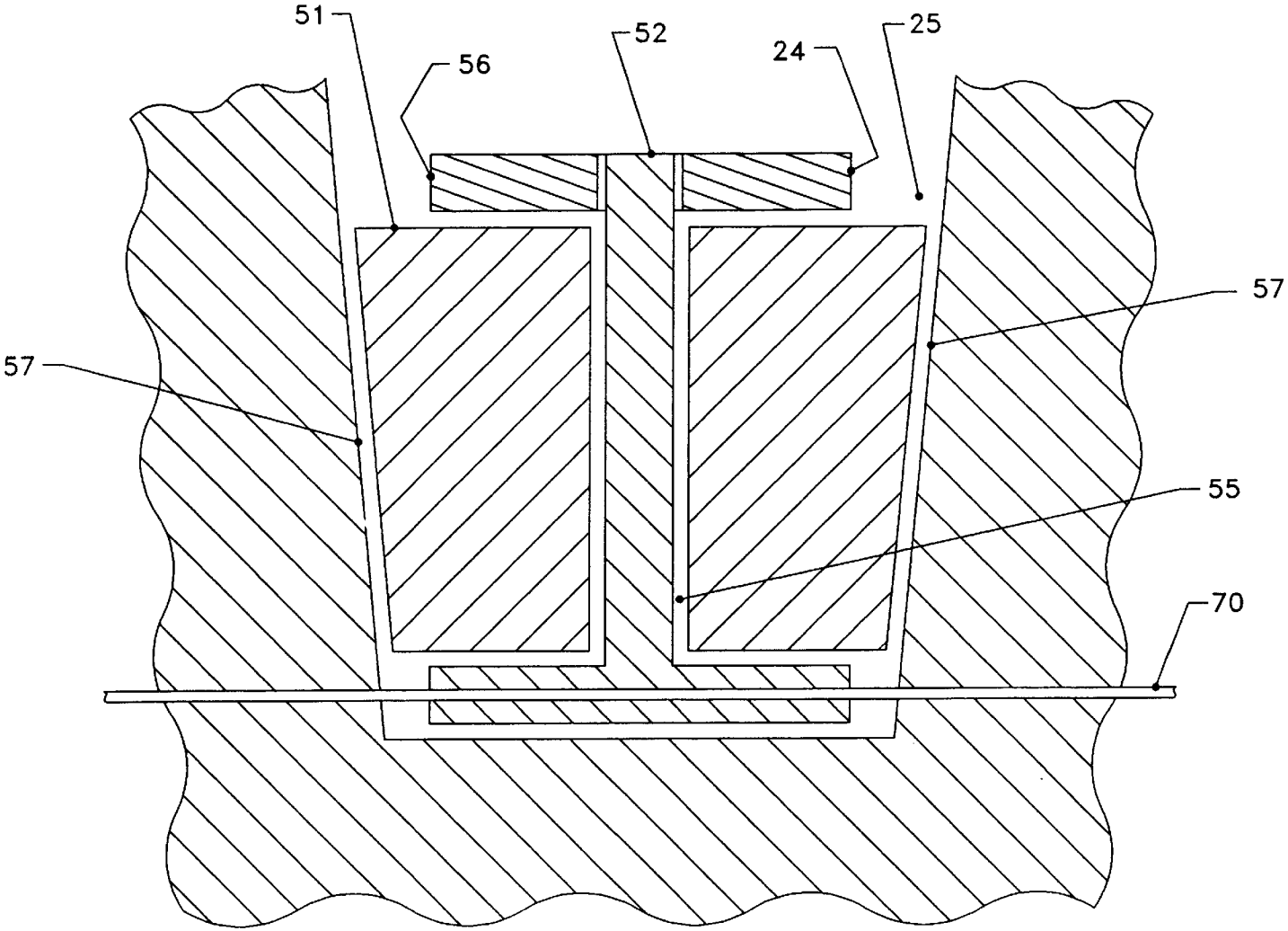
FIG. 17 is a diagrammatic sectional detail view of another embodiment of the invention with a slot having tapered inner walls and tapered roller bearings on the slot follower.

Referring now to FIG. 17, an alternative embodiment of the invention is shown in which tapered roller bearing 51' is mounted in aperture 55' in slot follower 24". Locking pin 70 holds radially disposed axle 52, on which tapered roller 51' rotates, in place. The slot 25" is correspondingly tapered. The inner walls 57' of the slot are closer together as the radial distance to the shaft axis reduced. The tapers are preferably selected such that the surface velocity of the inner walls of the slot which, increase with radial distance, are matched by the surface velocity of the roller from top to bottom. This may be achieved by providing a tapered roller having a ratio of bottom to top diameters that corresponds to the ratio of radii from the rotational axis of the inner wall points of contact with the bottom ant top surfaces of the roller.

The above disclosed invention has a number of particular features which should preferably be employed in combination, although each is useful separately without departure from the scope of the invention. While I have shown and described the preferred embodiments of my invention, it will be understood that the invention may be embodied otherwise than herein specifically illustrated or described, and that certain changes in form and arrangement of parts and the specific manner of practicing the invention may be made within the underlying idea or principles of the invention.

What is claimed is:

1. An apparatus that cuts foreign matter including lines, wires, nets and weeds of the type that may be-encountered by propeller driven vessels when under way, said vessels of the type where the propeller is mounted to a rotatable propeller shaft that extends from a propeller shaft housing connected to the vessel's hull, and in which there is axial movement of said shaft, said apparatus comprising:

(A) at least one first blade means for cutting, said first blade means having a first shearing plane, said first blade means arranged to rotate in conjunction with said propeller with said first shearing plane substantially perpendicular to the axis of said shaft;

(B) first support means for supporting said first blade means in position extending radially and beyond said first support means to engage said foreign matter, said first support means including means for fixedly attaching to at least one member of the pair consisting of said shaft and said propeller;

(C) at least one second blade means for cutting, said blade means having a second shearing plane, said second blade means arranged with said second shearing plane substantially parallel to said first shearing plane of said first blade means;

(D) second support means for supporting said second blade means in a position extending radially parallel to said first blade means to engage said foreign matter for shearing said foreign matter between said first and second blade means, said second support means including attaching means for fixedly attaching to a non-rotating member of said hull;

(E) said first blade means and said second blade means each having radially extending shearing edges at at least one margin of said shearing planes for cutting said foreign matter, when said propeller rotates;

(F) said second support means arranged to provide limited axial movement of second blade means with adjustable clamping means for engaging said second blade means with adjustable tension, said clamping means including elastic bias means having positive retention of compressive forces over prolonged time periods for maintaining preset tension;

(G) a combination of a slot means and a slot follower means for regulating the axial position of said second blade means, one of said combination of said slot means and said slot follower means connected to said first blade means and the other connected to said second blade means, each arranged in a plane perpendicular to said axis of said shaft and extending through an arc so that said slot follower means fits within said slot means during a fraction of each rotation of said shaft to regulate the axial position of said second blade means for close approximation of said first and second shearing planes for enhanced shearing action between said blade means, said slot means having opposed, radially disposed inner walls; said slot follower means having two radially disposed outer faces;

(H) said second support means providing limited pivotal movement of said second blade means, and further comprising a combination of a wedge means and a valley means for interacting to apply axial force to said second blade means toward said first blade means when said second blade means pivots in said second support means, wherein one of said combination of said wedge means and said valley means is connected to said second blade means and the other is connected to said second support means and said limited pivotal movement is generated by said foreign matter interposed between said first and second blade means during propeller rotation; and (I) at least one roller bearing means rotatably mounted on at least one radially disposed axle within said follower means, said roller bearing when so mounted for extending beyond at least one of said outer faces such that contact between said slot follower means and said slot means is limited to tangential contact of said roller bearing means against at least one of said inner walls of said slot means for reduced friction and wear therebetween.

2. The apparatus according to claim 1, in which said roller bearing means extends beyond both said outer faces of said slot follower means for tangential contact with one of said inner walls of said slot means.

3. The apparatus according to claim 2, in which said inner walls of said slot means are tapered, being closer together as the walls approach said shaft, and said roller bearing means are correspondingly tapered.

4. The apparatus according to claim 3, in which each of said blade means includes beveled ramp means at the radially outer edge thereof for preventing said shearing edges from striking one another.

5. The apparatus according to claim 4, further comprising annular face plate means for fastening to said propeller, at a forward face thereof, to provide a surface coplanar with a rear inner wall of said slot means.

6. The apparatus according to claim 1, in which each of said blade means includes beveled ramp means at the radially outer edge thereof for preventing said shearing edges from striking one another.

7. The apparatus according to claim 6, further comprising annular face plate means for fastening to said propeller, at a forward face thereof, to provide a surface coplanar with a rear inner wall of said slot means.

8. An apparatus that cuts foreign matter including lines, wires, nets and weeds of the type that may be encountered by propeller driven vessels when under way, said vessels of the type where the propeller is mounted to a rotatable propeller shaft that extends from a propeller shaft housing connected to the vessel's hull, and in which there is axial movement of said shaft, said apparatus comprising:

(A) at least one first blade means for cutting, said first blade means having a first shearing plane, said first blade means arranged to rotate in conjunction with said propeller with said first shearing plane substantially perpendicular to the axis of said shaft;

(B) first support means for supporting said first blade means in position extending radially and beyond said first support means to engage said foreign matter, said first support means including means for fixedly attaching to at least one member of the pair consisting of said shaft and said propeller;

(C) at least one second blade means for cutting, said blade means having a second shearing plane, said second blade means arranged with said second shearing plane substantially parallel to said first shearing plane of said first blade means;

(D) second support means for supporting said second blade means in a position extending radially parallel to said first blade means to engage said foreign matter for shearing said foreign matter between said first and second blade means, said second support means including attaching means for fixedly attaching to a non-rotating member of said hull;

(E)said first blade means and said second blade means each having radially extending shearing edges at at least one margin of said shearing planes for cutting said foreign matter, when said propeller rotates;

(F) said second support means arranged to provide limited axial movement of second blade means with adjustable clamping means for engaging said second blade means with adjustable tension, said clamping means including elastic bias means having positive retention of compressive forces over prolonged time periods for retaining preset tension adjustment;

(G) a combination of a slot means and a slot follower means for regulating the axial position of said second blade means, one of said combination of said slot means and said slot follower means connected to said first blade means and the other connected to said-second blade means, each arranged in a plane perpendicular to said axis of said shaft and extending through an arc so that said slot follower means fits within said slot means during a fraction of each rotation of said shaft to regulate the axial position of said second blade means for close approximation of said first and second shearing planes for enhanced shearing action between said blade means, said slot means having opposed, radially disposed inner walls; said slot follower means having two radially disposed outer faces;

(H) said second support means providing limited pivotal movement of said second blade means, and further comprising a combination of a wedge means and a valley means for interacting to apply axial force to said second blade means toward said first blade means when said second blade means pivots in said second support means, wherein one of said combination of said wedge means and said valley means is connected to said second blade means and the other is connected to said second support means and said limited pivotal movement is generated by said foreign matter interposed between said first and second blade means during propeller rotation; and (I) a plurality of roller bearing means rotatably mounted on radially disposed axles within said follower means, said roller bearing when so mounted for extending beyond both of said outer faces such that contact between said slot follower means and said slot means is limited to tangential contact of said roller bearing means against one of said inner walls of said slot means for reduced friction and wear therebetween.

9. The apparatus according to claim 8, in which said elastic bias means comprises an elastomer.

10. The apparatus according to claim 8, in which said elastic bias means comprises a polyurethane elastomer.

* * * * *